US006675897B1

(12) United States Patent
McGarian et al.

(10) Patent No.: US 6,675,897 B1
(45) Date of Patent: Jan. 13, 2004

(54) DOWNHOLE BYPASS VALVE

(75) Inventors: Bruce McGarian, Stonehaven (GB); Ian Gillies, Brechin (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/936,235

(22) PCT Filed: Feb. 25, 2000

(86) PCT No.: PCT/GB00/00691

§ 371 (c)(1),
(2), (4) Date: Nov. 2, 2001

(87) PCT Pub. No.: WO00/55472

PCT Pub. Date: Sep. 21, 2000

(30) Foreign Application Priority Data

Mar. 12, 1999 (GB) ..... 9905779

(51) Int. Cl.[7] ..... E21B 21/10

(52) U.S. Cl. ..... 166/321; 166/151; 166/152; 166/334.1; 166/334.4

(58) Field of Search ..... 166/321–120, 166/151, 152, 133, 374, 334.1, 334.4; 251/282, 63.6, 63.5

(56) References Cited

U.S. PATENT DOCUMENTS 4,162,691 A * 7/1979 Perkins ..... 137/613
4,768,598 A 9/1988 Reinhardt
5,156,207 A * 10/1992 Haugen et al. ..... 166/142
5,443,129 A 8/1995 Bailey et al.
6,095,249 A * 8/2000 McGarian et al. ..... 166/319
6,173,795 B1 * 1/2001 McGarian et al. ..... 175/231

FOREIGN PATENT DOCUMENTS

GB 2 307 932 A 11/1997

* cited by examiner

*Primary Examiner*—David Bagnell
*Assistant Examiner*—Giovanna M Collins
(74) *Attorney, Agent, or Firm*—Dykema Gossett PLLC

(57) ABSTRACT

The present invention relates to bypass valves for use in wellbores, particularly but not exclusively to bypass valves used during the setting of hydraulic anchor packers. A bypass valve (2) is provided with a piston (30) slidably mounted adjacent a body member (4) having at least one opening (20) extending therethrough. The piston (30) is moveable between a first position establishing a passage from the interior of the body (4) to the exterior thereof via the at least one opening (20) and a second position isolating the interior of the body (4) from the exterior thereof. A second piston may be provided for increasing, in response to a predetermined fluid pressure differential across the length of the piston (30), the force exerted on the piston (30) by a given flow of fluid through the bypass valve (2) such that the resultant force on the piston (30) is insufficient to move the piston (30) to the second position. Thus, the bypass valve (2) is adapted to provide an indication at the surface of an imminent closure. Once the indication is received, the bypass valve (2) may be closed, without the need for remedial action, by simply increasing the rate of fluid flow.

11 Claims, 3 Drawing Sheets

12
6
14
2
10
16
30
40
44
44
68
66
37
38
48
62
64
24
36
46
46
70
58
60
42
20
20
54
50
52
56
22
42
26
34
4
32
18
28
8
13

DOWNHOLE BYPASS VALVE

BACKGROUND OF THE INVENTION a. Field of the Invention

The invention relates to bypass valves for use in wellbores, particularly but not exclusively to bypass valves used during the setting of hydraulic anchor packers.

b. Description of Related Art

The drilling industry often has need to monitor the depth and angular orientation of a tool (such as a whipstock) within a wellbore and to rigidly secure the tool within the wellbore once a required position has been achieved. The depth and orientation of a tool is typically determined through use of a measurement-while-drilling (MWD) tool. However, MWD tools require a flow of wellbore fluid through a string in order to communicate a measured depth and orientation to the surface and the flow rates involved are often sufficiently high to prematurely set the hydraulic anchor packer in use.

To overcome this problem, strings are often provided with a bypass valve located between the MWD tool and the anchor packer. When the depth and orientation of the string is being monitored, wellbore fluid is pumped through the MWD tool via the string bore and then bled to the wellbore annulus so as to prevent the pressure differential across the hydraulic anchor packer rising to the level required for setting. Once the string has been arranged in the desired position, the hydraulic anchor packer is set by increasing of the flow rate of wellbore fluid down the string. The increase in flow rate results in an associated increase in dynamic pressure at the bypass valve. Once this dynamic pressure increases to a predetermined magnitude, the bypass valve is activated and the fluid path between the wellbore annulus and the string bore is closed. The wellbore fluid is thereby directed downhole to the anchor packers where the appropriate setting pressure (typically a 1500–3000 psi differential between the inside and outside of the anchor packer) is then applied.

A conventional bypass valve incorporates a piston which slides within a cylinder in response to dynamic wellbore fluid pressure. The wall of the cylinder is provided with a plurality of holes through which fluid may pass from the string bore to the wellbore annulus. The piston is held by biasing means (such as a spring), a shear pin or a combination thereof so as to permit fluid flow through said holes in the cylinder. However, when the predetermined dynamic pressure is achieved, the biasing means and/or shear pin is overcome and the piston slides within the cylinder so that said holes become sealingly closed.

A problem associated with this type of bypass valve is that no warning is given at the surface of an imminent closing of the bypass valve and, consequently, of a potentially imminent setting of the anchor packer. A bypass valve is disclosed in UK patent application no. 9625547.6 (publication no. GB 2 307 932 A) which incorporates means for controlling the movement of the piston within the cylinder. The disclosed arrangement is such that movement of the piston is initially restricted so that the cylinder holes are only partially closed. The restricted passage to the wellbore annulus thereby created results in increased pressure losses which may be detected at the surface. Nevertheless, the dynamic pressure at the bypass valve has been allowed to rise to the predetermined activating magnitude and remedial action (i.e. a cycling of the bypass valve) must then be taken before full closure of the cylinder holes can be achieved. This remedial action is time consuming and, in certain applications, can be inconvenient and potentially problematic.

SUMMARY OF THE INVENTION

Further prior art bypass valves to which the present invention pertains are disclosed in U.S. Pat. Nos. 4,768,598 and 5,443,129. The latter document describes a bypass valve according to the preamble of the appended claims. However, this prior art valve requires a partial closing of the fluid path between the valve interior and exterior which is achieved by movement of the piston.

It is an object of the present invention to provide a bypass valve for use in a wellbore which communicates an imminent closure of the bypass valve to the surface.

The present invention provides a bypass valve for selectively isolating the interior of a downhole assembly from the exterior thereof, the bypass valve comprising: a body incorporating a wall provided with at least one opening extending therethrough; a piston slidably mounted in the body such that a first position of the piston relative to the body establishes a passage from the interior of the body to the exterior of the body via the opening and such that a second position of the piston relative to the body substantially isolates the interior of the body from the exterior of the body; and means for increasing the force exerted on the piston by a given flow of fluid through the bypass valve such that the resultant force on the piston is insufficient to move the piston to the second position; characterised in that the force increasing means increases the force exerted on the piston in response to a predetermined flow of fluid through the bypass valve.

Thus, a bypass valve according to the present invention may be employed in downhole operations in a similar manner to prior art bypass valves. However, if the rate of fluid flow through the bypass valve is increased (either intentionally or unintentionally) so that said predetermined fluid flow is achieved. then said means is activated. As a consequence, the force exerted on the piston by fluid flowing through the bypass valve is increased. Although the resultant force on the piston is not sufficient to move the piston so as to effect closure, the activation of said means generates a reactive force which resists the fluid flow. This resistance can be detected at the surface and thereby provides an indication that the fluid pressure differential across the length of the piston has increased to a predetermined level and that further unchecked increases will result in closure of the bypass valve.

The force increasing means preferably comprises means for restricting the passage of fluid past the piston. Furthermore, the passage of fluid past the piston is preferably provided by a fluid pathway comprising a longitudinal bore extending through the piston. The fluid pathway ideally also comprises at least one aperture in the piston providing fluid communication between the piston bore and a fluid route past the piston being at least partially located exteriorly of the piston. In such an arrangement, the passage restricting means preferably comprises a second piston mounted in said piston bore so as to be slidably moveable between positions in which said at least one aperture is either open, closed or partially closed. It is preferable for the second piston to be biased into a position wherein said at least one aperture is open. Said piston may be biased by mean of a spring. Alternatively, the second piston may be held by means of a shear pin in a position wherein said at least one aperture is open. Preferably, the second piston is moveable into a position wherein said at least one aperture is closed. The second piston is preferably provided with a longitudinal bore extending therethrough.

Preferably, the geometry of the piston is such that the piston, once in said second position, is biased into said second position by means of a static fluid pressure differential across said piston.

A bypass valve according to the present invention thereby has the advantage over the prior art of providing an indication at the surface of an imminent closure of the bypass valve. Once said indication is detected, the bypass valve may be closed, without the need for remedial action, by simply increasing the rate of fluid flow down the associated string.

BRIEF DESCRIPTION OF THE DRAWINGS

Embodiments of the present invention will now be described with reference to the accompanying drawings, in which.

DETAILED DESCRIPTION OF THE PREFERRED EMBODIMENTS

Figure 1:
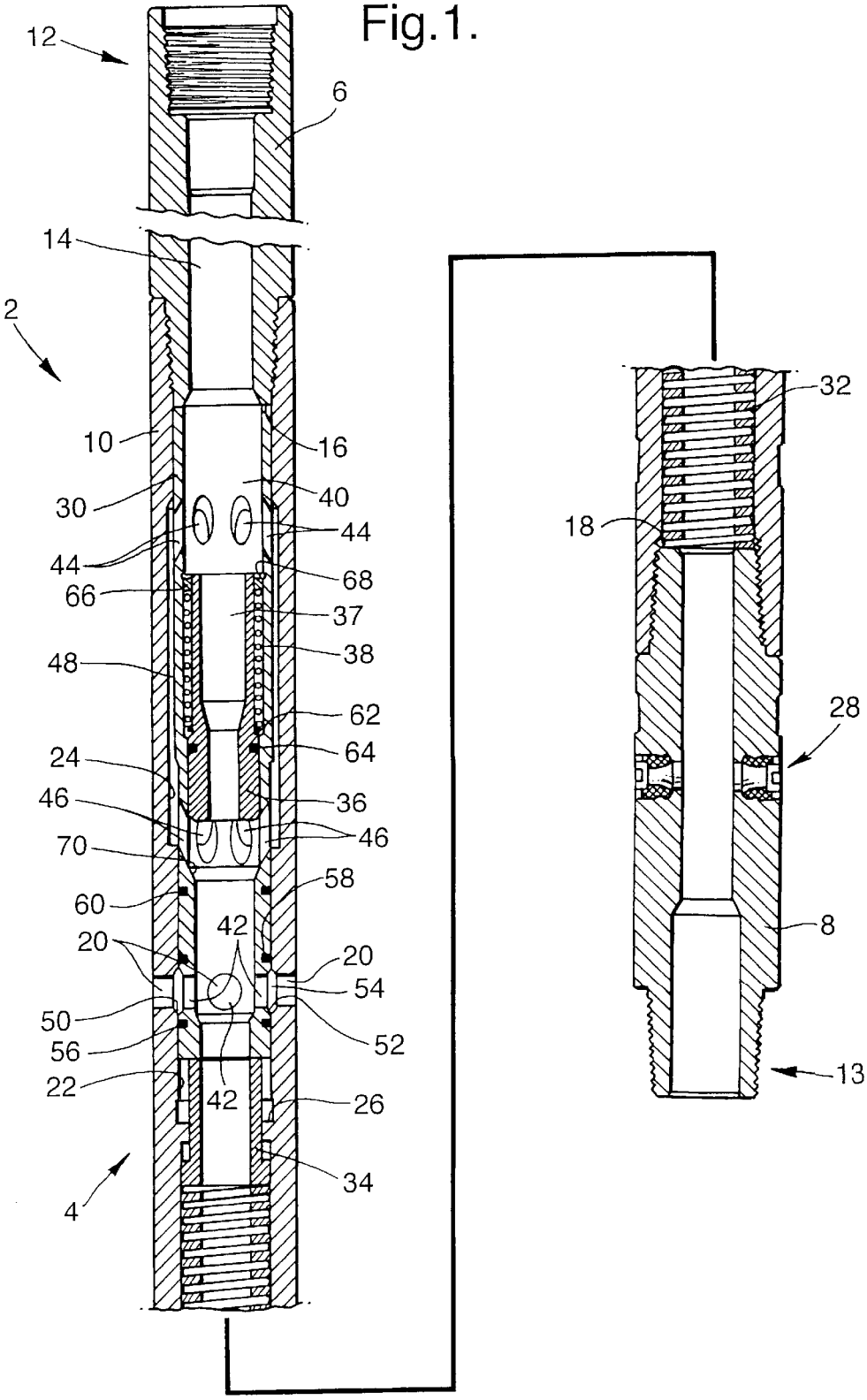
FIG. 1 is a cross-sectional side view of a first embodiment of the invention arranged in an unset configuration.
Figure 2:
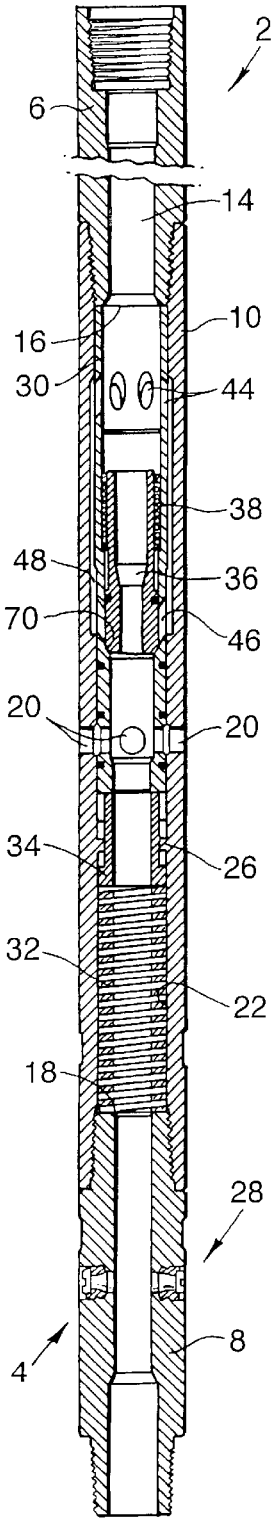
FIG. 2 is a cross-sectional side view of said first embodiment arranged in a partially set configuration.
Figure 3:
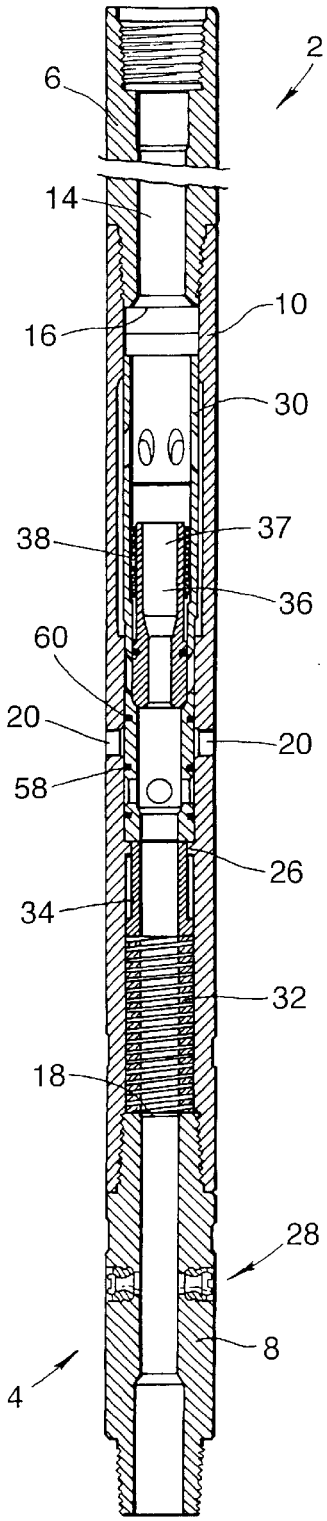
FIG. 3 is a cross-sectional side view of said first embodiment arranged in a set configuration.

A first bypass valve 2 according to the present invention is shown in FIGS. 1, 2 and 3. This bypass valve 2 comprises a cylindrical body 4 housing a number of internal components moveable in response to dynamic fluid pressure.

The cylindrical body 4 is defined by top and bottom subs 6,8 respectively threadedly engaged with the uphole and downhole ends of a central body element 10. The top sub 6 is provided with a female connector 12 for threadedly engaging the uphole end of the bypass valve 2 with a string. Similarly, the bottom sub 8 is provided with a male connector 13 for threadedly engaging the downhole end of the bypass valve 2 with a string. The assembled elements of the cylindrical body 4 define a longitudinal bore 14 in which the aforementioned moveable components are located. Axial movement of said components within the bore 14 is restricted by means of a downhole facing internal shoulder 16 provided by the downhole end of the top sub 6 and an uphole facing internal shoulder 18 provided by the uphole end of the bottom sub 8. Furthermore, fluid communication between the exterior of the cylindrical body 4 and the longitudinal bore 14 thereof is permitted by means of four apertures 20 extending laterally through the wall of the central body element 10. The body apertures 20 are equispaced about the longitudinal axis of the bypass valve 2 and are arranged in a common plane which is prpendicular to said longitudinal axis.

The internal surface 22 of the central body element 10 is provided with a recess 24 located uphole of the body apertures 20 which, as will be described below, allows a secondary flow of fluid through the bypass valve 2 during use. Furthermore, the internal surface 22 is provided with an annular stop member 26. This stop member 26 is located downhole of the body apertures 20 and radially projects into the bore 14. In use, the stop member 26 provides means for constraining the aforementioned moveable components in addition to the downhole and uphole facing internal shoulders 16,18.

Appropriate pressure relief means 28 (for example, a burst disc, a pressure relief valve. or a number of suitably sized nozzles) is provided in the bottom sub 8 so as to allow the escape of fluid from the bore 14 when the static pressure therein increases to a predetermined level. The fluid pressure within the bypass valve 2 may be thereby retained within acceptable limits. In this way, undesirable damage to the bypass valve 2 and the associated string, particularly during an anchor setting operation, may be avoided.

As mentioned above, a number of moveable components are retained within the bore 14 between the downhole and uphole facing internal shoulders 16,18. These components include a primary piston 30, a primary compression spring 32, a primary piston extension member 34, a secondary piston 36, and a secondary compression spring 38.

The primary piston 30 is generally cylindrical in shape and defines a primary piston bore 40. The downhole portion of the primary piston 30 is provided with four laterally extending piston apertures 42. The piston apertures 42 are similar to the body apertures 20 both in size and in arrangement. In addition to these apertures 42, the uphole portion of the primary piston 30 is provided with a first set of secondary piston apertures 44. These apertures 44 are equi-spaced about the longitudinal axis of the bypass valve 2 and are arranged in a common plane perpendicular to said axis. Furthermore, each of the secondary piston apertures 44 extends from the primary piston bore 40 in a downhole and radially outward direction. A generally central portion of the primary piston 30 is provided with a second set of secondary piston apertures 46. The apertures 44,46 of the first and second sets are arranged about said longitudinal axis in an identical manner and are identical in size. However, the second set of secondary piston apertures 46 differs from the first set in that each aperture 46 of the second set extends from the primary piston bore 40 in an uphole and radially outward direction. The directions in which the secondary piston apertures 44,46 extend reduce the pressure losses associated with a fluid flow through the bypass valve 2. Both said first and second sets are comprised of the six secondary piston apertures. An alternative number of apertures 44,46 may be used as appropriate.

The primary compression spring 32 is located downhole of the primary piston 30 and abuts the uphole facing internal shoulder 18. The primary piston extension member 34 is located between the primary piston 30 and the primary compression spring 32. The arrangement is such that the primary compression spring 32 presses the primary piston extension member 34 into abutment with the primary piston 30 which is in turn pressed uphole into abutment with the downhole facing internal shoulder 16.

With the primary piston 30 pressed against the downhole facing internal shoulder 16 as shown in FIG. 1, the bypass valve 2 is arranged in an unset configuration. In this configuration, the primary compression spring 32 is sufficiently compressed to prevent premature downhole movement of the primary piston 30. Furthermore, the geometry of the primary piston 30 is such that, when positioned as shown in FIG. 1 (i.e when the bypass valve 2 is in the unset configuration), the first set of secondary piston apertures 44 is located adjacent the uphole region of body element recess 24, the second set of secondary piston apertures 46 is located adjacent the downhole region of the body element recess 24, and the piston apertures 42 are located adjacent the body apertures 20.

In the unset configuration, the first and second sets of secondary piston apertures 44,46 provide fluid communication between the primary piston bore 40 and the body element recess 24. Thus, fluid passing through the bypass valve 2 will tend to flow both along the entire length of the primary piston bore 40 and also along a secondary path which bypasses a central section of the bore 40. In following the secondary path, a downhole flow of fluid passes from the primary piston bore 40 through the first set of secondary piston apertures 44 and into an annular passage 48 defined by the body element recess 24 and the external surface of the primary piston 30. Said fluid then flows downhole through the annular passage 48 and back into the primary piston bore 40 via the second set of secondary piston apertures 46.

Furthermore, with the bypass valve 2 arranged in the unset configuration, fluid communication between the piston apertures 42 and the body apertures 20 is ensured by means of a circumferential recess 50 provided in the interior surface of the central body element 10 and a circumferential recess 52 provided in the exterior surface of the primary piston 30. The circumferential recesses 50,52 are respectively provided in the region of the body apertures 20 and the piston apertures 42. Accordingly, with the bypass valve 2 arranged in the unset configuration, the body apertures 20 and piston apertures 42 are in fluid communication with one another by means of an annular space 54 defined by the circumferential recesses 50,52. A leakage of fluid from the annular space 54 (i.e. into any space between the central body element 10 and the primary piston 30) is prevented by means of two O-ring seals 56,58. A third O-ring seal 60 is also provided so as to prevent the ingress of wellbore fluid through the body aperture 20 when the bypass valve 2 is in the set configuration shown in FIG. 3.

The secondary piston 36 is located within the primary piston bore 40 between the first and second sets of secondary piston apertures 44,46 (when the bypass valve 2 is arranged in the unset configuration). The secondary piston 36 is generally cylindrical in shape and has a bore 37 extending therethrough. The downhole end portion of the secondary piston 36 is received within the primary piston bore 40 downhole of an uphole facing internal shoulder 62 provided on the interior surface of the primary piston 30. An O-ring seal 64 located below said shoulder 62 prevents leakage of fluid between the primary and secondary pistons 30,36. The uphole end of the secondary piston 36 is provided with a spring stop 66 which is annular in shape and retained adjacent the secondary piston 36 by means of a circlip (not shown). The secondary compression spring 38 is located between the spring stop 66 and the uphole facing internal shoulder 62 of the primary piston 30. When the bypass valve 2 is in the unset configuration, the secondary compression spring 38 presses the secondary piston 36 uphole into abutment with a circlip 68 mounted in the primary piston bore 40. The arrangement is such that the secondary piston 36 may be moved downhole relative to the primary piston 30 and close the second set of secondary piston apertures 46. When the second set of secondary piston apertures 46 are closed in this manner, the bypass valve 2 is arranged in the partially set configuration (see FIG. 2).

During use, the bypass valve 2 is typically located in a string downhole of a MWD tool and uphole of a hydraulic anchor packer and is run down a wellbore in the unset configuration shown in FIG. 1. In this way, fluid may be pumped down the string so that the depth and orientation of the packer may be monitored using the MWD tool. As in the prior art, premature setting of the packer is prevented by virtue of a bleeding of fluid from the interior of the bypass valve to the wellbore annulus. With reference to FIG. 1, it can be seen that the bleeding of fluid from the string is achieved by means of the fluid pathway provided by the body and piston apertures 20,42 and the annular space 54.

If the rate of fluid flow through the bypass valve increases (either intentionally or unintentionally) to a predetermined level sufficient to overcome the bias of the secondary compression spring 38, then the secondary piston 36 moves downhole within the primary piston bore 40. The downhole movement of the secondary piston 36 is limited by means of a stop 70 provided on the primary piston 30, but is sufficient to close the second set of secondary piston apertures 46. The secondary flow of fluid via the annular passage 48 is thereby prevented. Consequently, with the bypass valve 2 arranged in the partially set configuration, all the fluid passing through the bypass valve 2 must flow through the primary piston bore 40 and the secondary piston bore 37. This results in an increase in the force exerted by the fluid flow on the primary piston 30. However, the stiffness of the primary compression spring 32 is such that this increased force is not sufficient to move the primary piston 30 downhole within the cylindrical body 4 and set the bypass valve 2. Nevertheless, the increased force corresponds with an increased pressure loss which may be clearly detected at the surface.

Once in the partially set configuration, the bypass valve 2 may be set by further increasing the rate of fluid flow through the bypass valve. If the setting of the bypass valve 2 is not required, then the detected movement of the secondary piston 36 suggests that the fluid flow rate should be reduced so as to avoid accidental setting in the event of a unintentional further fluid flow rate increase. Appropriate remedial action may then be taken.

Once the fluid flow rate through the bypass valve 2 is sufficient to overcome the bias of the primary compression spring 32, the primary piston 30 will move downhole within the cylindrical body 4 so as to sealingly close the body apertures 20. All fluid entering the bypass valve 2 is then directed downhole through the string so that the required anchor setting pressure may be generated. Once the anchors have been set, the bypass valve 2 may be placed back into the unset configuration by simply reducing the rate of fluid flow.

Figure 4:
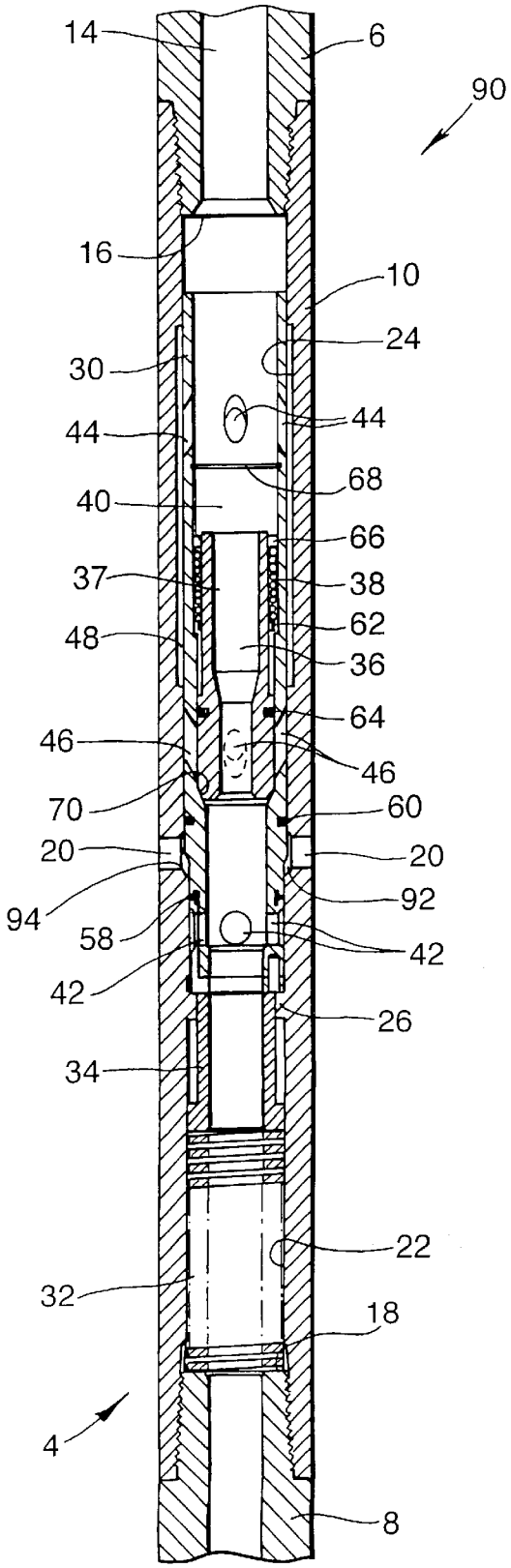
FIG. 4 is a cross-sectional side view of a second embodiment of the invention arranged in a set configuration.

A second bypass valve 90 according to the present invention is shown, in a set configuration, in FIG. 4. The second bypass valve 90 is substantially identical to the first bypass valve 2 and corresponding components are labelled in the drawings with the same reference numerals. A minor difference between the two embodiments is the different number of secondary piston apertures 44,46 employed. However, the important difference between the two embodiments is in the design of the primary piston 30 which is provided with a downhole facing external shoulder 92 located between the O-ring seals 58,60 used to seal the body apertures 20 when in the set configuration. A corresponding uphole facing internal shoulder 94 is provided on the internal surface 22 of the central body element 10 at a location below the body apertures 20. The arrangement is such that, when the second bypass valve 90 is in the set configuration, a static fluid pressure differential is generated across the length of the primary piston 30, the magnitude of which is sufficient to resist the bias of the primary compression spring 32 and therefore maintain the bypass valve 90 in the set configuration without the need for a circulation of fluid through the string. Once set, the second bypass valve 90 may be opened by bleeding off fluid pressure at the surface.

The present invention is not limited to these specific embodiments described above. Alterative embodiments will be apparent to a reader skilled in the art.

What is claimed is:

1. A bypass valve for selectively isolating the interior of a downhole assembly from the exterior thereof, the bypass valve comprising:

a body incorporating a wall provided with at least one opening extending therethrough;

a piston slidably mounted adjacent the body such that a first position of the piston relative to the body establishes a passage from the interior of the body to the exterior of the body via the at least one opening and such that a second position of the piston relative to the body substantially isolates the interior of the body from the exterior of the body; and means for increasing, in response to a predetermined fluid pressure differential across the length of the piston, the force exerted on the piston by a given flow of fluid through the bypass valve such that the resultant force on the piston is insufficient to move the piston to the second position, wherein said means for increasing increases the force exerted on the piston by a given fluid flow rate in response to a predetermined flow of fluid through the bypass valve.

2. A bypass valve as claimed in claim 1, wherein the geometry of the piston is such that the piston, once in said second position, is biased into said second position by means of a static fluid pressure differential across said piston.

3. A bypass valve as claimed in claim 1, wherein the force increasing means comprises means for restricting the passage of fluid past the piston.

4. A bypass valve as claimed in claim 3, wherein the passage of fluid past the piston is permitted by a fluid pathway comprising a longitudinal bore extending through the piston.

5. A bypass valve as claimed in claim 4, wherein the fluid pathway further comprises at least one aperture in the piston providing fluid communication between the piston bore and a fluid route past the piston being at least partially located exteriorly of the piston.

6. A bypass valve as claimed in claim 5, wherein the passage restricting means comprises a second piston mounted in said piston bore so as to be slidably moveable between positions in which said at least one aperture is opened or closed to varying extents.

7. A bypass valve as claimed in claim 6, wherein the second piston is biased into a position permitting fluid communication through said at least one aperture.

8. A bypass valve as claimed in claim 7, wherein the second piston is biased by means of a spring.

9. A bypass valve as claimed in claim 6, wherein the second piston is held by means of a shear pin in a position permitting fluid communication through said at least one aperture.

10. A bypass valve as claimed in claim 6, wherein the second piston is moveable into a position in which said at least one aperture is closed so as to prevent fluid communication therethrough.

11. A bypass valve as claimed in claim 6, wherein the second piston is provided with a longitudinal bore extending therethrough.

* * * * *